US005343809A

United States Patent [19]

Wennberg et al.

[11] Patent Number: 5,343,809

[45] Date of Patent: Sep. 6, 1994

[54] WEAPON WITH GUIDING WIRE

[75] Inventors: Lennart Wennberg, Kungsängen; Lena Sarholm, Dalarö; Egon Svensson, Tyresö; Jan Erikson, Sollentuna; Ralf Holmlin, Södertälje, all of Sweden

[73] Assignee: Forsvarets Forskningsanstalt, Sundbyberg, Sweden

[21] Appl. No.: 50,093

[22] PCT Filed: Sep. 12, 1991

[86] PCT No.: PCT/SE91/00607

§ 371 Date: May 12, 1993

§ 102(e) Date: May 12, 1993

[87] PCT Pub. No.: WO92/04591

PCT Pub. Date: Mar. 19, 1992

[30] Foreign Application Priority Data

Sep. 12, 1990 [SE] Sweden ..... 9002905-9

[51] Int. Cl.[5] ..... F42B 23/00

[52] U.S. Cl. ..... 102/401; 102/371; 102/504

[58] Field of Search ..... 102/371, 374, 401, 437, 102/504; 244/3.12; 89/1.701, 1.34

[56] References Cited

U.S. PATENT DOCUMENTS

| | | | |
|---|---|---|---|
| 1,142,396 | 6/1915 | Broady | 102/504 |
| 3,156,185 | 11/1964 | Hermann et al. | 244/3.12 |
| 4,574,680 | 3/1986 | Nicodemus | 89/1.701 |
| 4,907,763 | 3/1990 | Pinson | 244/3.12 |
| 5,035,169 | 7/1991 | Chapin et al. | 244/3.12 |
| 5,133,520 | 7/1992 | Daly | 244/3.12 |

FOREIGN PATENT DOCUMENTS

| | | | |
|---|---|---|---|
| 2753494 | 6/1979 | Fed. Rep. of Germany | 102/504 |

*Primary Examiner*—Harold J. Tudor

*Attorney, Agent, or Firm*—Jacobson, Price, Holman & Stern

[57] ABSTRACT

The invention relates to a weapon whose main object is to attack targets, such as armoured tanks, from above unexpectedly. The weapon includes an active part (1), a propulsion unit, such as a launching device (2), an anchorage attachment (4) which is intended to be firmly anchored in relation to the terrain, and a line (3) whose first end (5) is attached to the active part (1) and whose second end (6) is pivotally attached to the anchorage attachment (4). When used, the active part (1) is launched vertically upwards, with the line (3) held taut, whereafter the active part is guided by the line through the air in a circular arcuate path or trajectory (8) to a target (7), with the centre of the arcuate trajectory in the anchorage attachment (4).

7 Claims, 3 Drawing Sheets

WEAPON WITH GUIDING WIRE

TECHNICAL FIELD

The present invention relates to a weapon, and particularly to a concealed weapon for attacking such targets as armoured tanks.

BACKGROUND ART

Concealed anti-tank weapons have hitherto mainly consisted of anti-tank mines. Such mines, which may comprise a solid or a shaped explosive charge, are buried in the ground and attack the tank from beneath. The effective radius of a mine of this kind is very small, and consequently it is necessary for a tank to be located generally above the mine in order to sustain damage. Such mines are, nevertheless, extremely effective weapons, since the underside of the tank, where the tank propulsion means are located, is susceptible to damage. The threat presented by mines, however, can be eliminated, by clearing a path through a mine field with the aid of mine flails and mine plows, the path cleared need not be wider than the width of the actual tanks themselves.

Also described in the literature are sighted weapons, which propel a fragment through the effect of a shaped charge. These weapons are concealed on one side of the contemplated or anticipated path of the target, and attack the target from the sides or from the front thereof. Although positioning of such weapons on one side of the path travelled by the target makes it necessary to clear a wider path than that required in the case of mines, therewith possibly reducing the speed at which the vehicles advance, the sides and the fronts of the vehicles attacked by such weapons are heavily armoured and consequently these weapons have a limited effect.

DISCLOSURE OF THE INVENTION

The object of the present invention is to provide a weapon which is not encumbered with the drawbacks of the aforesaid known weapons.

In accordance with the present invention, there is proposed a weapon, particularly a concealment weapon, which in the case of the preferred embodiment is intended to attack the upper side of an armoured tank, this upper side being as susceptible to damage from attack as the undersides of such tanks, in many respects. Even though an attack may fail to destroy a tank, the tank will carry on the upper sides thereof weapons, aiming equipment, communication equipment, etc., which if put out of action will render the tank unfit for combat.

The weapon includes an active part, for instance an explosive charge, a propulsion unit which functions to propel the active part of the weapon in a trajectory through the air, an attachment for anchoring the weapon in the terrain, and a line which functions to guide the active part, wherein a first end of the line is attached to said active part and a second end thereof is pivotally attached to the weapon anchorage attachment.

The propulsion unit may be a device which is integral with the active part, such as a rocket motor or an explosive charge together with a countermass. In the case of the first alternative embodiment, however, there is used a launching unit which is separate from the active part of the weapon and which is fixed to the ground in the terrain. The active weapon part is intended to be propelled or launched vertically upwards, although vertical launching is not a necessary prerequisite.

When preparing the weapon for use, on flat ground the anchorage attachment is fixed at a distance from the location of the anticipated target which corresponds to the length of the line, and the launching unit with the active part fitted thereto is located at an additional distance of one line length in line with the two first mentioned places. When the weapon is used, the active part is launched vertically upwards by the launching device and then travels in a substantially arcuate trajectory while guided by the line, with the centre of the trajectory lying in the anchorage attachment and said trajectory extending to the site of the anticipated or contemplated target. If the terrain is not flat, the active part is launched in a direction which forms a tangent to said arc. When fired, the active part must have an initial velocity which is at least sufficiently high for the centrifugal force generated on the active part to hold the line taut during the whole of the distance travelled by the active part. By selecting the aforesaid criteria of the preferred embodiment, which are not necessary for carrying out the invention, the active part will not be influenced by lateral forces in dead calm conditions. Thus, the trajectory followed by the active part will extend exactly above the anchorage attachment in a vertical plane which also includes the position of the contemplated target, whereas the distance from the launching device to the target is determined by the length of the line. Although a high degree of accuracy is achieved with this arrangement, accuracy can be impaired by lateral forces caused by side winds. A lateral spread in the impact point of the active part can be decreased, by ensuring that the passage of the active part in said trajectory has as short duration as possible. Consequently, when launching the active part, its initial velocity should be as high as possible without the centrifugal force acting on the active part becoming so great as to break the line.

The velocity of the active part can be increased and/or the dimensions of the line decreased with the aid of auxiliary devices, such as fins which can be adjusted positionally to exert on the active part a dynamic force which is directed towards the anchorage attachment. In order to decrease lateral spread still further, it is proposed in accordance with the invention that two lines are used with two mutually-spaced anchorage attachments, as described as an alternative to the preferred embodiment.

The weapon may advantageously be concealed, e.g. by camouflaging the weapon in places where the enemy is very likely to move in a state of war, such as geographically determined routes, for instance mountain passes, river crossings, and the like. Because the anchoring attachment of the weapon can be placed at a considerable distance from the contemplated path of the enemy, the enemy is forced to clear a much larger area than when conventional mines are used, in which latter case it is only necessary to clear a path equal to the width of the tank. In this way, the inventive weapon is able to considerably delay an advance by the enemy.

A very high degree of impact accuracy is achieved with the inventive weapon, as distinct to the accuracy achieved with free-flying weapons, such as mortar shells. Because a very high velocity can be maintained, there is obtained a tactically advantageous short trajectory time.

The weapon can be used as a complement to conventional mines. Since they attack the susceptible upper side of the tank, smaller charges can be used than those used in conventional mines therewith allowing obsolete mines of this kind to be returned to active use.

The weapon is not restricted in use to armoured tanks and similar combat vehicles. It can also be used against military entrenchments, rifle trenches, boats, aircraft, and the like. Neither is the inventive weapon limited to following a path which is included by a vertical plane. If the path is obstructed by a tree or if the two anchorage attachments are located at mutually different heights, for example when using two lines in an undulating terrain, the plane which includes the trajectory and the device for guiding the active part in said trajectory may be angled to a vertical plane. Ignoring gravitational forces, which have only a small effect in the case of short trajectory times, the trajectory will then follow another of the great circles of a sphere although in flat terrain and nevertheless reach impact on the outer extremity of the same diameter, i.e. on the target. A further use is one in which the active part is a robot. The robot is released from the lineguided path or trajectory and then continues its journey along the tangent towards a target. This enables robots to be launched from, for instance, protected sites, such as in wooded countryside.

BRIEF DESCRIPTION OF THE DRAWINGS

The invention will now be described in more detail with reference to the accompanying drawings which illustrate the inventive weapon and in which.

DESCRIPTION OF A PREFERRED EMBODIMENT

Figure 1:
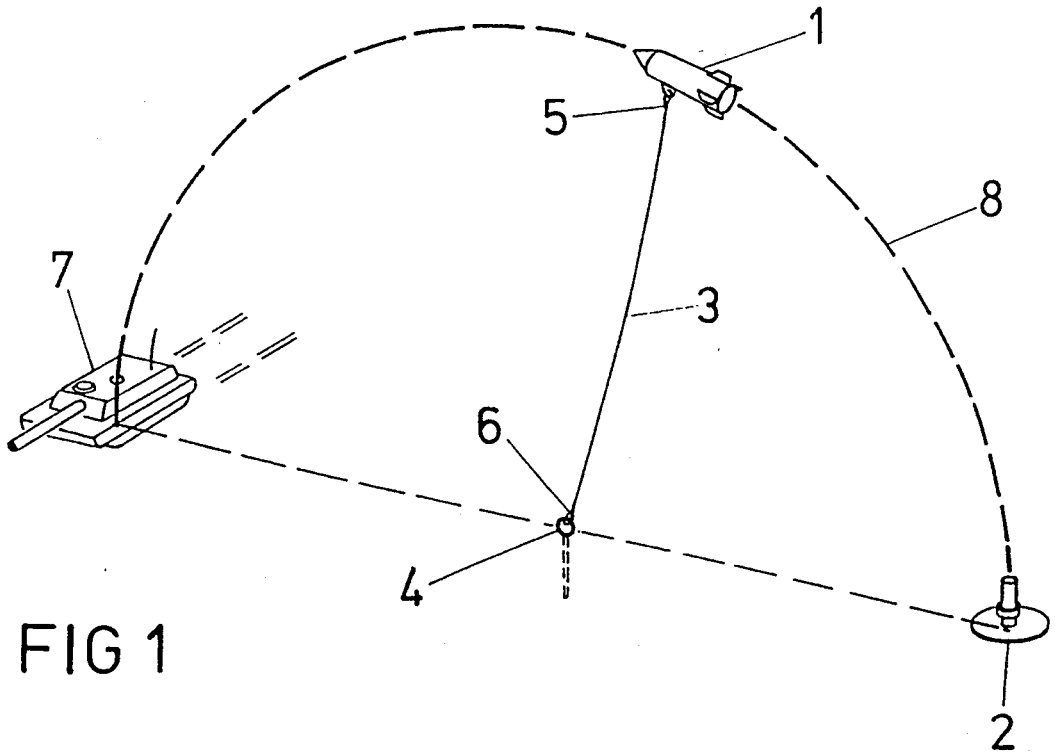
FIG. 1 is a perspective view of the weapon equipped with one line.

In its simplest form, the weapon illustrated in FIG. 1 comprises an active weapon part 1, a propulsion means 2, a line 3 and a ground attachment 4 which functions as an anchorage attachment. One end 5 of the line is attached to the active part 1 while the other end 6 of the line is attached pivotally to the anchorage attachment 4. The propulsion means of the illustrated embodiment has the form of a launching device which is charged with a propellant and which, when in use, is placed on the ground and, in the case of flat terrain, is intended to launch the active part vertically upwards. When the weapon is to be used, the active weapon part and the launching device 2 are positioned so that the line 3 is generally taut, with the anchorage attachment located between the location of the launching device and a contemplated target 7. The active part 1 is launched at a sufficiently high velocity, whereafter the active part is guided by the line 3 to move in a semicircular, arcuate trajectory 8 which is included in a vertical plane and which has its centre in the anchorage attachment, so as to deliver an overhead attack onto the target 7 at the end of the trajectory.

Figure 2:
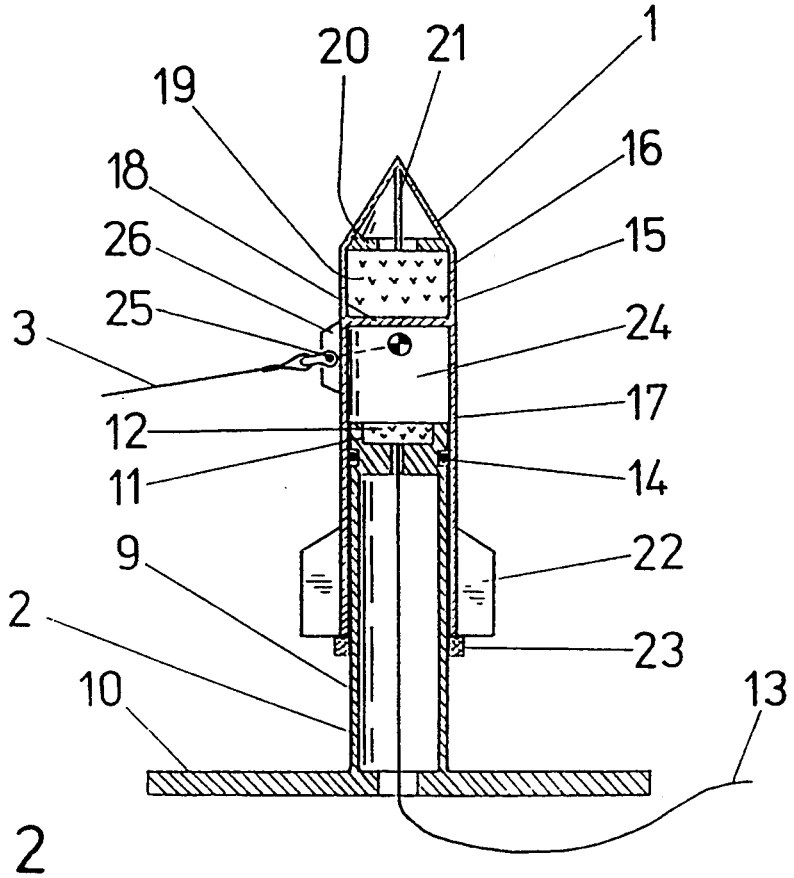
FIG. 2 is a longitudinal section view which illustrates in detail the active part of the weapon and a separate launching or propulsion device.

In view of the weapon criteria selected, it is advantageous aerodynamically to configure the active part as a finned projectile. FIG. 2 illustrates the launching device 2 of this embodiment with a projectile 1 in launching position. The launching device comprises an upright post 9 and a circular support plate 10. The bottom end of the post 9 is firmly mounted in the centre of the support plate 10, so as to extend vertically upwards therefrom. Formed in the upper end of the post 9 is a cup-like receptacle 11 which accommodates a propulsive charge 12. Electrical conductors 13 which function to initiate firing of the propulsive charge in a conventional manner, e.g. as a result of being triggered by a sensor of some kind or another, or by manual remote firing, extend from the propulsive charge 12, through the tube and out therefrom. A seal 14 is seated in a groove machined in the upper end of the post, the function of which will be described hereinafter.

Tests have shown that a projectile according to FIG. 2 gives a high degree of accuracy to the weapon itself. The cylindrical body 15 of the projectile includes a forward charge-carrying part 16 and a rearward tubular part 17, said parts being separated by a transverse wall 18. The charge-carrying part is able to accommodate an explosive charge constructed for the purpose intended or, for instance, a mine 19 obsolete for combating modern tanks, wherein an iron ring 20 and a detonating rod 21 are mounted forwardly of the mine. Alternatively, the charge-carrying part may accommodate a charge which includes fragments and which is detonated at a given height above the ground, or a container which functions to spray liquid over the ground.

The outer surface of the rearward tubular part 17 is fitted with fins 22. The bore of this tubular part has a smooth surface and the diameter and length of the bore is such as to enable the tubular part to be pushed down onto the post 9 of the launching device with a close fit therebetween, until it reaches a collar 23, which can be moved axially along the post and against which the trailing edge of said rearward tubular part is able to rest. The aforesaid seal 14 on the upper end of the post is intended to seal between said post and the inner surface of the tubular part. Since the tubular part is closed upwardly by the transverse wall 18, there is formed in said tubular part an explosive chamber 24 which is defined downwardly by the upper end of the post and the seal 14. The acceleration path and the volume of the explosive chamber can be adjusted, by changing the vertical position of the collar 23 on the tube. This enables differing initial velocities to be obtained when launching with propulsion charges 12 of mutually equal magnitudes. The possibility of adjusting the launching velocity is important, since a higher initial velocity is desirable when using a longer line 3, as described above.

The line 3 is attached to the body of the projectile 15 by means of a plate 26, which is welded to said body and provided with a hole 25. Since the line obtains a arcuate shape, due to air resistance, the hole 25 is positioned at a distance rearward of the gravitational centre of the projectile, so that a geometric line in the extension of the projectile-guiding line will essentially extend through said gravitational centre. The projectile hereby obtains stable passage in its journey through the air.

The other end of the line is attached to the ground anchorage 4, which may have the form of a pile driven into the ground and fitted with an eye, an eye-bolt secured to a rock face, a boulder, a tree stump, a concrete-cast foundation stone, or some like device. The line may be made of carbon fibres or fibres of aramide or polyethylene plastic, a steel wire or piano wire, and may have considerable length. The air resistance of the line can be greatly decreased, by providing the line with a droplet-shaped cross-section. The ends of the line are folded double so as to form eyes terminated with press-on fittings and are attached respectively to the plate 26 of the projectile and to the ground anchorage attachment by means of a shackle or like device. The pivotal movement of the line at the ground anchorage can be achieved, for instance, between shackle and eye or by bending a rigidly secured line.

Figure 6:
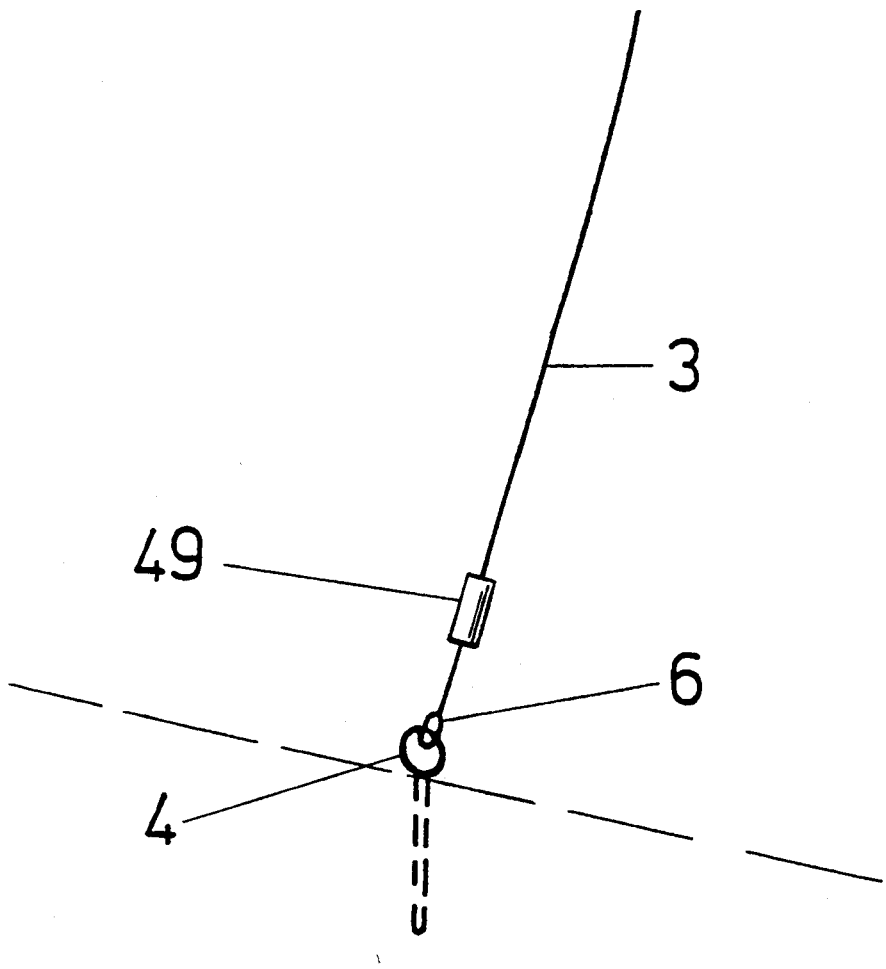
FIG. 6 illustrates an explosive charge fitted to a line

In this case of the simplest embodiment, the positions of the ground anchorage and the launching device in the terrain fully determine the point of impact of the active part, this impact point normally being at a distance from the ground anchorage equal to a line length on an extension of a straight connecting line between the launching device and the ground anchorage. When the launching device is in a fixed position, it may be necessary to change the point of impact achieved with said device. In a further development of the invention (see FIG. 3), vertical fins 27 that have moveable surfaces 28 are used. Rotation of the surfaces results in a guiding force which moves the calculated point of impact further away from the extension of the aforesaid line, the extent of this distance depending on the extent to which the surfaces are rotated. The moveable surfaces may, for instance, be replaced with asymmetric speed-retarding element. On the other hand, if it is desired to extend the distance between the point of impact and the ground anchorage, this can be achieved by breaking the holding force exerted by-the line during travel of the active part, for instance by severing the line. The active part will then leave the arcuate trajectory in a tangential direction and thus reach an impact point which is further away from the ground anchorage. The line can be severed, for instance, by means of a device provided with an explosive charge 49 and fitted to the line as shown in FIG. 6. The charge may be fired in a known way, such as electrically. When an electrically-conducting line is used, the explosive charge can be initiated with the aid of a stand located between the ground anchorage and the estimated point of impact. When the line is swung so far around the ground anchorage that it comes into contact with the stand, an electric circuit which includes the stand, the line, an explosive charge detonator and the ground anchorage is completed, thereby firing the explosive charge and severing the line.

Figure 4:
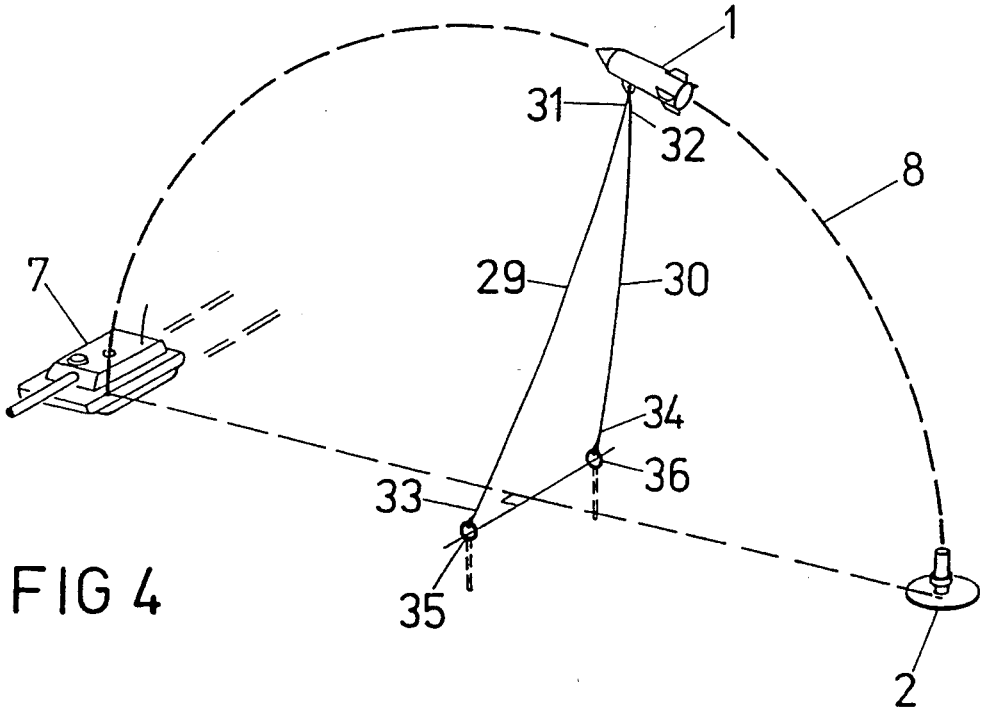
FIG. 4 is a perspective view of a development of the weapon equipped with two lines.

The simplest form of the inventive weapon, illustrated in FIG. 1, has a slightly poorer accuracy when strong side winds prevail. FIG. 4 illustrates an alternative embodiment of the weapon which is far less sensitive to wind. Instead of a single line, the lines 29, 30 which are preferably of equal lengths and the first ends 31, 32 of which are attached to the projectile 1 and the second ends 33, 34 of which are each attached to a respective ground anchorage 35, 36 which are mutually spaced apart and placed on a geometric line which extends perpendicularly to a further line which extends from the launching device 2 between the ground anchorages 35, 36 in the case of flat ground and equally long lines, centrally between said anchorages. In the case of this embodiment, the projectile is also guided laterally, thereby resulting in greater accuracy.

Figure 3:
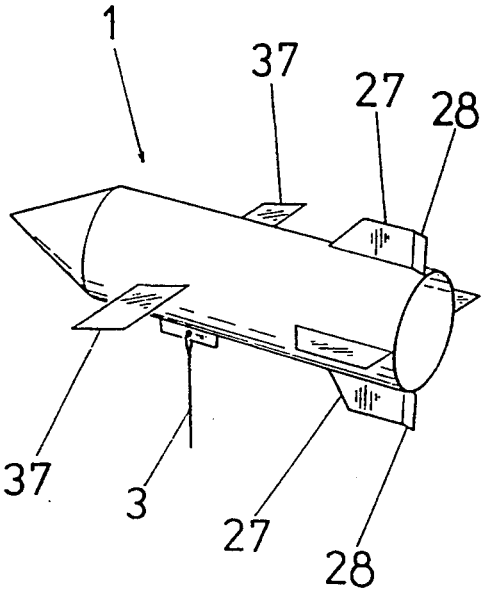
FIG. 3 is a perspective view of a development of the active part.

As described in the introduction, the velocity of the active part in the trajectory shall be at least sufficiently high for the centrifugal force generated to hold the line taut. The velocity should preferably be still higher, since a short travel time is favourable with respect to spread due to side winds, and also from a tactical aspect. A desired high velocity, however, may generate a centrifugal force of such high magnitude as to cause the line to break due to overloading. According to one development of the invention (see FIG. 3), the active part is therefore provided, e.g., with downwardly bent, horizontal fins but preferably wings on the level of the centre-of-gravity of the active part between its gravity centrepoint and the line attachment or alternatively on a separate means between the attachment and the line, said fins being intended to generate a force which is directed towards the ground anchorage and which can counteract a part of the centrifugal force. This enables the use of a thinner line with subsequent lower air resistance and therewith alleviating associated problems and/or enables a higher velocity to be used. FIG. 3 illustrates an embodiment which includes horizontal wings 37 which are intended to exert the aforesaid compensating, dynamic force.

Figure 5:
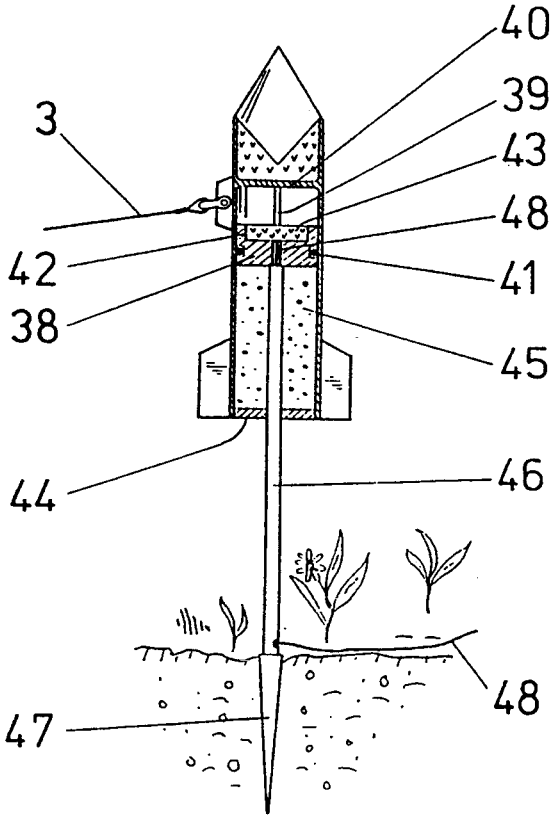
FIG. 5 illustrates an alternative active part having an integrated propulsion means.

FIG. 5 illustrates a propulsion means which is an alternative to the preferred embodiment, in which the rearward tubular part is constructed for use in the absence of the aforsaid separate launching device. In the case of this embodiment, a plunger 38 is mounted in the internal, smooth-bore barrel up to a spacer means 39 which holds the plunger spaced from the partition wall 40. A seal 41 is fitted in a groove machined in the plunger and is intended to seal between said plunger and the inner tube wall. A cup-like device 42 for accommodating a propulsive charge 43 is formed on the side of the plunger facing towards the charge-carrying part of the projectile. The tube barrel is filled with a counter-mass 45 from the other side of the plunger up to a plug 44 fitted to the tube outlet, the counter-mass 45 in this case consisting of sand. A hollow rod 46 extends through the plug and the counter-mass to the plunger 38. The outermost end of the rod is provided with a point 47 which enables the active part to be positioned by driving the rod into the ground. Electric charge-firing conductors 48 extend through the rod and the plunger, up to the propelling charge. When launching the projectile, the plunger pushes the counter-mass out through the tube outlet, thereby propelling the active part into its trajectory. The initial velocity of the active part can be adjusted by varying the position of the plunger in the tubular barrel, by changing the length of the spacer means.

We claim:

1. A weapon comprising:

a projectile, a line attached at one end of said line to said projectile and at an opposite end of said line to an anchorage attachment, said anchorage attachment being fixed in relation to a site of a contemplated target, a propulsion unit associated with said projectile for propelling said projectile at least at a velocity such that said line will be held taut when said projectile travels in a circular arcuate path towards the contemplated target, said circular arcuate path being achieved with the aid of a restraining force exerted by said line, and aiming means for directing said projectile towards said circular arcuate path, said anchorage attachment being located between said aiming means and said site of said contemplated target so that said line is generally taut.

2. A weapon according to claim 1, wherein there is solely one said line; and said anchorage attachment and said circular arcuate path generated by said aiming means are contained in a vertical plane, which also includes a contemplated impact point on the contemplated target.

3. A weapon according to claim 1, wherein there are two lines, first ends of which are attached to said projectile, and second ends of which are each attached to different ones of said anchorage attachment and another anchorage attachment; and said path generated by the aiming means is included in a vertical plane which also includes a contemplated impact point on the contemplated target; and said anchorage attachment and said another anchorage attachment are each placed on a respective side of this plane.

4. A weapon according to claim 1, wherein said propulsion unit is a propulsive explosive charge and a counter-mass.

5. A weapon according to claim 1, wherein said projectile includes surfaces which assist the restraining force exerted by the line.

6. A weapon according to claim 1, further comprising means for releasing a connection of said projectile with said anchorage attachment located between said projectile and said anchorage attachment, such that said projectile will continue in a trajectory tangentially to an initial circular arcuate trajectory after release of said connection.

7. A weapon according to claim 6, wherein said projectile is a robot; and said robot is released by said releasing means subsequent to having travelled around a portion of said circular arcuate trajectory.

* * * * *